United States Patent [19]

Edwards

[11] Patent Number: 4,528,691

[45] Date of Patent: Jul. 9, 1985

[54] ALTERNATING VARIABLE DELAY CONTROL ARRANGEMENT AND METHOD FOR PUSH-PULL AUDIO TRANSDUCERS

[76] Inventor: Edward W. Edwards, 815 E. Oakton, Box 226, Des Plaines, Ill. 60018

[21] Appl. No.: 540,539

[22] Filed: Oct. 11, 1983

[51] Int. Cl.[3] ..... H04R 1/02

[52] U.S. Cl. ..... 381/97; 381/89

[58] Field of Search ..... 381/89, 94, 97, 98

[56] References Cited

U.S. PATENT DOCUMENTS

| | | | |
|---|---|---|---|
| 3,054,856 | 9/1962 | Arany | 381/89 |
| 3,477,540 | 11/1969 | Rizo-Patron R. | 181/31 |
| 4,016,953 | 4/1977 | Butler | 181/144 |
| 4,100,371 | 7/1978 | Bayliff | 179/1 E |
| 4,130,727 | 12/1978 | Kates | 179/1 D |
| 4,137,510 | 1/1979 | Iwahara | 333/6 |
| 4,349,697 | 9/1982 | Skabla | 179/1 D |

FOREIGN PATENT DOCUMENTS

| | | | |
|---|---|---|---|
| 2712451 | 9/1978 | Fed. Rep. of Germany . | |
| 57-3498A | 1/1982 | Japan | 381/89 |

*Primary Examiner*—Forester W. Isen

*Attorney, Agent, or Firm*—Mason, Kolehmainen, Rathburn & Wyss

[57] ABSTRACT

A control system is provided with an alternating variable delay control arrangement for the control of a push-pull transducer system from an audio input signal source to achieve improved reproduction of high fidelity sound. The push-pull transducer system in one arrangement is of the type including two transducers coaxially disposed relative to each other with each transducer including a cone and an electrically actuated drive arrangement for each cone. The bases of the cones are in facing relationship and arranged to define a chamber therebetween. The control system supplies drive signals to the electrical drive arrangements of each transducer so as to drive the respective cones 180° out of phase relative to each other. Further the control system selectively delays the supplied audio input signal to the electrically actuated drive arrangement corresponding to the cone that is being driven in the direction toward the apex of the cone. The selective delay is accomplished in a predetermined manner based on the time for the sound to travel between the two cones through the medium in the chamber. The delay time is selectively adjustable for compensation of specific cone characteristics, cone mounting, barometric changes etc.

11 Claims, 2 Drawing Figures

ALTERNATING VARIABLE DELAY CONTROL ARRANGEMENT AND METHOD FOR PUSH-PULL AUDIO TRANSDUCERS

BACKGROUND OF THE INVENTION

1. Field of the Invention

The present invention relates generally to a control system and method for operation of push-pull audio transducer arrangements and more particularly to a reduction in harmonic distortion and improvement in high fidelity reproduction in the operation of push-pull audio transducer systems by supplying two coaxially disposed face to face arranged transducers with drive signals that are 180° out of phase relative to each and with a selected delay provided to the transducer being driven away from the face to face interface, the delay being provided as based on the time for sound to travel between the transducers and through the medium in the chamber defined therebetween.

2. Description of the Prior Art

Push-pull audio transducer systems for the improved reproduction of high fidelity sound are shown in U.S. Pat. Nos. 4,016,953 and 3,477,540 and German Pat. No. 2,712,451. For example, in U.S. Pat. No. 4,016,953, two speakers, 12, 14 are disposed face to face and in coaxially aligned relationship. As shown in that patent, the electrically actuated drive arrangement for each cone of a respective speaker is operated 180° out of phase with respect to the other as shown in FIGS. 7 and 8 of that patent such that as one cone is being driven toward its apex the other cone is being driven toward its base and vice versa.

U.S Pat. Nos. 4,349,697, 4,137,510, 4,130,727, and 4,100,371 disclose various arrangements for audio systems that utilize delay arrangements.

While the arrangements of the prior art are generally suitable for their intended use and provide improvement in reproduction of high fidelity sound and the like, it would be desirable to provide improved control systems and methods for audio transducer systems of the push-pull variety.

SUMMARY OF THE INVENTION

Accordingly, it is a principal object of the present invention to provide a control system and method for a push-pull transducer system that reduces harmonic distortion and thus improve the quality of reproduction of the audio input by supplying each transducer with a drive input signal 180° out of phase with respect to the other and with selective delays being introduced to provide the compression wave of the transducer being driven toward the interface of the push-pull transducers to the transducer being driven away from the transducer interface at the optimum time for the transducer configuration.

It is another object of the present invention to provide a control system and method for operation of a push-pull audio transducer system by supplying drive signals to each transducer that are 180° out of phase with respect to each other and selectively delaying the signal to the respective transducer that is being driven away from the transducer interface by approximately the time for sound to travel between the two transducers and thus supply the compression wave of the transducer being driven toward the interface to the transducer being driven away from the interface at the optimum time for the cone configuration.

These and other objects of the present invention are efficiently achieved by providing a control system for the control of a push-pull transducer system from an audio input signal source to achieve improved reproduction of high fidelity sound. The push-pull transducer system in one arrangement is of the type including two transducers coaxially disposed relative to each other with each transducer including a cone and an electrically actuated drive arrangement for each cone. The bases of the cones are in facing relationship and arranged to define a chamber therebetween. The control system supplies drive signals to the electrical drive arrangements of each transducer so as to drive the respective cones 180° out of phase relative to each other. Further the control system selectively delays the supplied audio input signal to the electrically actuated drive arrangement corresponding to the cone that is being driven in the direction toward the apex of the cone. The selective delay is accomplished in a predetermined manner based on the time for the sound to travel between the two cones through the medium in the chamber. The delay time is selectively adjustable for compensation of specific cone characteristics, cone mounting, barometric changes etc.

The invention both as to its organization and method of operation together with further objects and advantages thereof will best be understood with reference to the following specification taken in conjunction with the accompanying drawings.

DESCRIPTION OF THE PREFERRED EMBODIMENT

Figure 1:
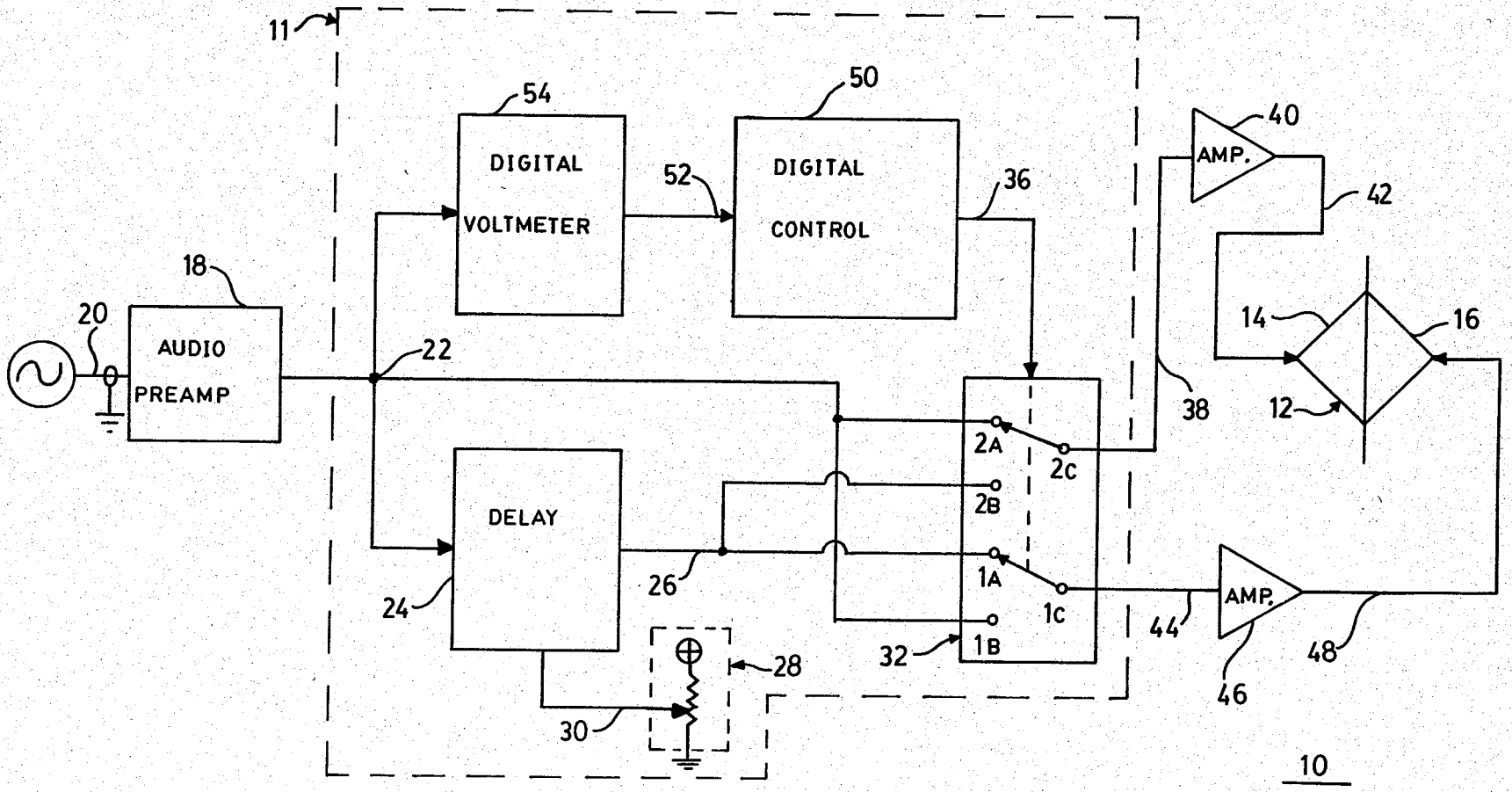
FIG. 1 is a block diagram and schematic representation of the control system of the present invention to practice the method of the present invention.

Referring now to FIG. 1, the control system 10 of the present invention includes an alternating variable delay control arrangement 11 for practicing the method of the present invention. The control system 10 via the alternating variable delay control arrangement 11 supplies audio input signals to the push-pull audio transducer arrangement 12 including a first transducer 14 and a second transducer 16. The transducers 14, 16 are of the general type referred to as speakers 12, 14 of U.S. Pat. No. 4,016,953 which is hereby incorporated by reference for all purposes.

The control system 10 includes an audio preamplifier stage 18 that is responsive to an audio input signal source at 20 to provide an amplified output at 22. The amplified audio output 22 is connected to the input of a variable delay stage 24 of the alternating variable delay control arrangement 11. The variable delay stage 24 provides an audio output at 26 identical to the audio input 22 but delayed in time by a predetermined delay time interval. In the preferred embodiment, the delay time interval is user adjustable by means of delay control 28 via a control input 30 to the variable delay stage 24.

The delayed output 26 is connected to a first contact lA of a first pole 30 of a double-pole, double-throw (DPDT) switch 32 of the alternating variable delay control arrangement 11. The delayed output 26 is also connected to a second contact 2B of the second pole 34 of the DPDT switch 32. As shown in FIG. 1, the A contacts of the poles 30 and 34 are the normally closed contacts and the B contacts are the normally open contacts. The switch 32 is controlled between the normally open and normally closed positions by means of a control input 36. The switch 32 is of a general type characterized as a solid state analog switch available as an integrated circuit or as implemented by FET switch stages.

The contact 2A of the pole 34 and the contact lB of the pole 30 are connected to the output 22 of the audio preamplifier stage 18. The common contact 2C of the pole 34 is connected via signal line 38 to an amplifier 40. The amplified output 42 of the amplifier 40 is connected to the electrically actuated drive arrangement of the transducer 14. Similarly, the common contact lC of the switch pole 30 is connected via line 44 to an amplifier 46. The output 48 of the amplifier 46 is connected to the electrically actuated drive arrangement of the transducer 16.

In accordance with the present invention, the switch 32 via the control input 36 is conditioned as shown in FIG. 1 to supply the amplified audio signal 22 to drive the transducer 14 when the rate of change of the audio input signal is positive so as to drive the cone of the transducer 14 toward its base while the transducer 16 is supplied via amplifier 46 with the delayed audio signal at 26 so as to drive the cone of transducer 16 toward the apex; the appropriate delay time corresponding to the time for the sound to travel between the two cones of the transducers 14, 16 such that the compression wave of the cone of the transducer 14 is supplied to the cone of the transducer 16 at the optimum time for the cone configuration and the characteristics of the medium, e.g. air, in the chamber defined between the interfacing cones of the transducers 14, 16.

The delay time introduced in delay stage 24 is variable in the preferred embodiment such that a user or maintenance personnel adjusts the delay for transducer characteristics and climatic changes as well as desired user audio preferences. For example, it is recommended that the user adjust the control 28 to obtain maximum syllable "$\overline{oo}$" or sustained tone for any program content. In alternative arrangements, the delay is set to a predetermined time for the specific transducer characteristics and the average medium parameters.

While the ground reference and ground connections to the various stages have been omitted in FIG. 1 for clarity it should be understood as shown in U.S. Pat. No. 4,016,953 that the electrically actuated drive arrangements for the transducers 14, 16 such as the drive coils 32, 34 of FIGS. 6 through 8 of that patent are interconnected out of phase for opposite polarity operation so that the combination push-pull transducer cones are driven in phase in space.

The control input 36 of the switch 32 is connected to an output control line of a digital control stage 50 of the alternating variable delay control arrangement 11. The digital control stage 50 includes a data input 52 that is connected to the output of a digital voltmeter or voltage measuring stage 54 of the alternating variable delay control arrangement 11. The input to the digital voltmeter stage 54 is connected to the output 22 of the audio amplifier stage 18. The digital control stage 50 via input 52 operates at a predetermined sampling rate to determine whether the rate of change of the audio signal is positive or negative and appropriately controls the control input 36 to operate the switch 32 as described hereinbefore to provide the delayed audio signal to the appropriate transducer 14, 16.

Figure 2:
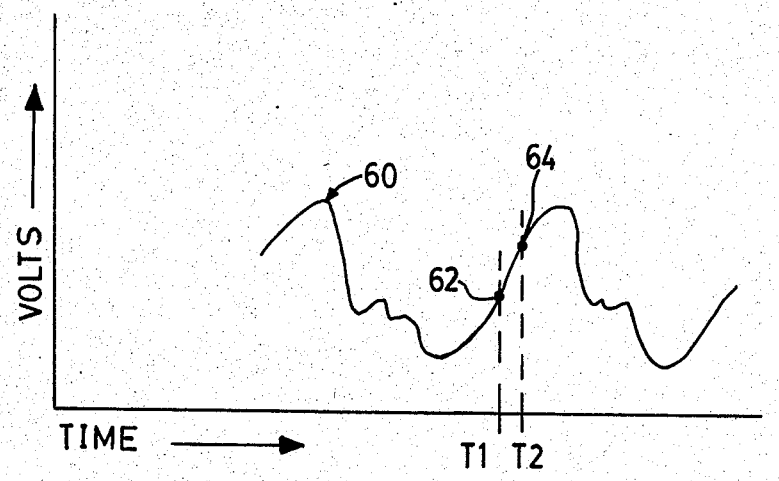
FIG. 2 is a graphical representation of a typical audio signal input waveform to illustrate the method of operation of the invention of FIG. 1.

For example, and referring now to FIG. 2, the audio waveform 60 represents a typical audio signal waveform at 22 in terms of a voltage waveform versus time as referenced to a zero volt reference for convenience. A vertical reference line at time $T_1$ defines a particular sampled voltage point of the waveform 60 at 62 and the vertical reference line at time $T_2$ corresponds to a sampled voltage at 64 of the waveform 60. In the example of FIG. 2 between times $T_1$ and $T_2$, the rate of change between waveform samples 62, 64 is positive. Thus a positive rate of change is sampled at 52 by the digital control stage 50.

In FIG. 1, for example, a positive rate of change detected by the digital stage 50 is arranged to provide a predetermined signal state to the control input 36 to condition the switch 32 to the normally closed position illustrated. Accordingly, the delayed signal from 26 is connected to the transducer 16 corresponding to the transducer for example having a cone apex facing the listener or audience and the undelayed signal is connected to the transducer 14 corresponding to the rear transducer with the cone base facing the listener or audience. Conversely, if the result of the rate of change sampling of the waveform 60 results in a negative rate of change, the digital control stage 50 changes the status of line 36 so as to condition the switch 32 from the position shown in FIG. 1 to close the normally open contacts of poles lB and 2B such that the delayed audio signal from 26 is connected through amplifier 40 to transducer 14 and the undelayed signal is connected to the transducer 16.

The digital voltmeter stage 54 in one arrangement for typical push-pull transducer systems provides a measurement rate per second of approximately 15 to 30,000 voltage measurements per second with three significant figures of voltage measurement. The digital control stage 50 calculates and outputs the sign of the difference of two consecutive voltage samples in memory in 5–10 microseconds for example in one arrangement. Further the response of the switch 32 is in the range of 5 to 25 microseconds for suitable operation.

The time delay of the variable delay stage 24 is adjustable by the control 28 via input 30 in the range of zero to one milisecond for typical high fidelity push-pull transducer systems. However, while the present embodiment has been described with a variable delay, it should also be understood that the delay stage 24 in various other embodiments provides a fixed delay time period.

While a single push-pull transducer system 12 of one particular type has been discussed it should be realized that the present invention is applicable to various types of push-pull audio transducer systems and operation of more than one pair of push-pull transducer systems 12. Additionally, it should be realized that for reproduction systems having more than one output channel, the arrangement in FIG. 1 may be expanded to provide additional appropriate drive signals such as 42 and 48 to additional channels with respective push-pull transducers systems such as 12.

In a preferred embodiment the digital control stage 50 is implemented by a microprocessor for example such as a TMS 1000 or TMS1100 single chip microprocessor manufactured by Texas Instruments, Inc. and suitable for real time control applications. The control input 36 for example is provided at one of the outputs 0 of the microprocessor and the sample input at 52 is provided at one of the inputs Kl, etc.

While the operation of the digital control stage 50 has been described hereinabove in connection with operation of the control system 10, the following operation steps illustrates a suitable program or program flow operation for the implementation of the digital control stage 50:

| STEP | DESCRIPTION |
|---|---|
| 1 | ENTER SENSE INPUT $T_n$ AT 52 to REGISTER #1 |
| 2 | ENTER SENSE INPUT $T_{n+1}$ AT 52 TO REGISTER #2 |
| 3 | SUBTRACT REGISTER #1 CONTENTS FROM REGISTER #2 |
| 4 | STORE SIGN OF RESULT OF STEP 3 |
| 5 | A. IF RESULT IN 4 IS PLUS (POSITIVE RATE OF CHANGE) CONDITION OUTPUT LINE AT 36 TO OUTPUT 1 STATE FOR NORMALLY CLOSED SWITCH CONTACTS OF FIG. 1<br>B. IF RESULT IN 4 IS MINUS (NEGATIVE RATE OF CHANGE) CONDITION OUTPUT LINE AT 36 TO OUTPUT 2 STATE TO CLOSE NORMALLY OPEN SWITCH CONTACTS OPPOSITE TO FIG. 1 |
| 6 | ERASE REGISTER #1 |
| 7 | MOVE CONTENTS OF REGISTER #2 TO REGISTER #1 |
| 8 | RETURN TO STEP 2 |

While the listed steps are described as program steps for operation, it should also be realized that these steps can be organized into a flow chart. However, for clarity the program is shown as a series of steps since there are no complicated branches or multiple paths but instead basically represent sequential operation.

While there has been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A control arrangement for a push-pull audio transducer system of the type including two transducers coaxially disposed relative to each other and each including a cone and an electrically actuated drive arrangement for the cone, the bases of the cones being in facing relationship and arranged to define a chamber therebetween, the control arrangement comprising:

delay means connected to an audio signal input source for providing at an output a delayed audio signal that is delayed by a predetermined time interval with respect to the audio signal input source;

means responsive to the audio signal input source for generating a switching control input based on the polarity of the rate of change of the audio signal input source; and means responsive to said audio signal input source and said delayed audio signal output for selectively connecting each of the drive arrangements for the two transducers to a different one of said delayed audio signal or said audio signal input source in response to said switching control input, said drive arrangements being connected in opposite phase relationship.

2. The control arrangement of claim 1 wherein said predetermined time interval is determined by the approximate time for sound to move between the transducers.

3. The control arrangement of claim 1 wherein said delay means comprises variable delay adjustment means for selectively varying said predetermined time interval.

4. The control arrangement of claim 3 wherein said variable delay adjustment means comprises manual adjustment means.

5. The control arrangement of claim 1 wherein said switching control input generating means comprises means responsive to said audio signal input source for determining the rate of voltage change of said audio signal input source versus time.

6. The control arrangement of claim 5 wherein said switching control input generating means provides a first output state switching control input when said rate of change is positive and provides a second output state switching control input when said rate of change is negative.

7. The control arrangement of claim 5 wherein said rate of change determining means operates at a predetermined rate which is greater than the maximum frequency of interest in said audio signal input source.

8. The control arrangement of claim 5 wherein said rate of change determining means comprises means for sampling the voltage of said audio signal input source at a predetermined rate which is greater than the maximum frequency of interest in said audio signal input source.

9. The control arrangement of claim 1 wherein said selective connecting means comprises switching means, said switching means providing the function of a double-pole, double-throw switch.

10. The control arrangement of claim 9 wherein said switching means includes two outputs, each output being connected to a drive arrangement of a respective transducer, said switching means comprising commonly controlled double-pole, double-throw switch means, each pole of the switch means including normally open contact means, normally closed contact means and common contact means, each of the common contact means being connected to a respective one of said outputs, said double-pole, double throw switch means being controlled between said normally open and normally closed states by said switching control input.

11. The control arrangement of claim 10 wherein said audio signal input source is connected to the normally closed contact means of a first pole and the normally open contact means of the second pole, said delayed audio signal output being connected to the normally open contact means of said first pole and the normally closed contact means of said second pole.

* * * * *